United States Patent [19]

Engel

[11] 4,169,323

[45] Oct. 2, 1979

[54] MEANS FOR PRODUCING MULTI-COLORED HOBBY CRAFT DESIGNS

[76] Inventor: Robert W. Engel, 2745 Provincetowne, Toledo, Ohio 43613

[21] Appl. No.: 848,292

[22] Filed: Nov. 3, 1977

[51] Int. Cl.[2] ..... B44D 2/00; B05D 1/30

[52] U.S. Cl. ..... 35/26; 428/13; 428/188

[58] Field of Search ..... 35/26, 27, 28, 66, 65; 40/160; 156/63; 273/157 R; 428/13, 187, 188; 248/473

[56] References Cited

U.S. PATENT DOCUMENTS

| | | | |
|---|---|---|---|
| 2,511,947 | 6/1950 | Samuels | 35/15 X |
| 2,581,492 | 1/1952 | Lowe | 35/62 |
| 2,825,150 | 3/1958 | Steiner | 35/26 |
| 3,166,860 | 1/1965 | Delaney | 35/72 X |
| 3,553,855 | 1/1971 | Oberg | 35/26 |
| 3,659,365 | 5/1972 | Eaton | 35/28 UX |
| 3,819,436 | 6/1974 | Allen | 35/26 X |

FOREIGN PATENT DOCUMENTS

| | | | |
|---|---|---|---|
| 6708/7 | 5/1957 | France | 35/65 |

OTHER PUBLICATIONS

Miniature Greenhouse Terrarium with Decorative Sandscaping Materials, p. 320, Sears 1975 Xmas Catalog.

*Primary Examiner*—Harland S. Skogquist
*Attorney, Agent, or Firm*—Henry K. Leonard

[57] ABSTRACT

A sand art hobby craft kit which includes a plurality of substantially transparent tubes which preferably are parts of a unitary structure. The combination also includes a plurality of supplies of differently colored flowable media, preferably sand. There is the outline on the front face of the structure of a design that defines areas to be colored differently. The combination also includes means such as a base for supporting the tubes in vertical position with their upper ends open and for closing the lower ends of the tubes. A color indicia chart indicating the colors for each area also is provided. Color bearing flowable media other than sand may be provided, if desired. The color indicia chart may be a colored print of the final design such as a picture, or it may have each area of the picture color coded to the supplies of color bearing media.

5 Claims, 20 Drawing Figures

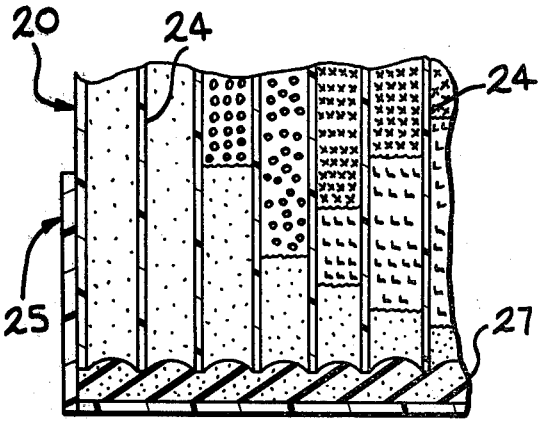
FIG. 11
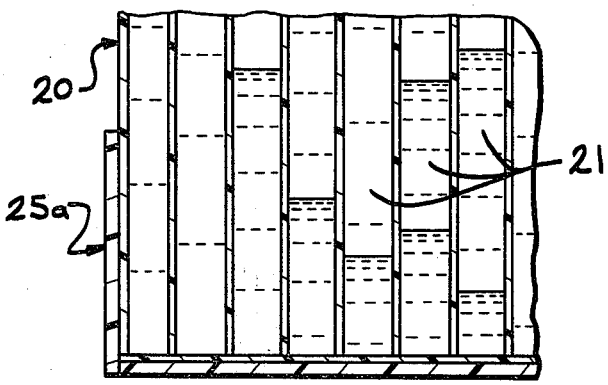
FIG. 12
FIG. 13
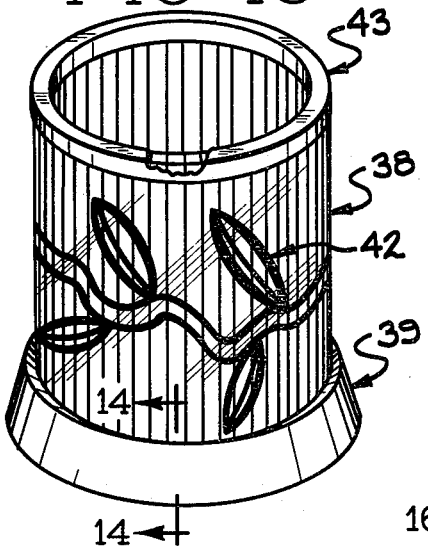
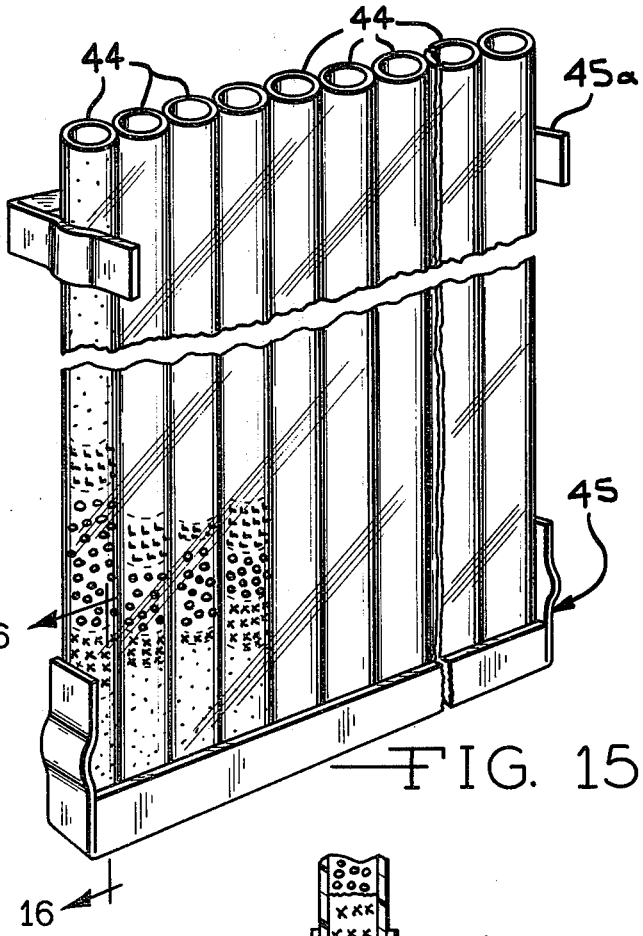
FIG. 15
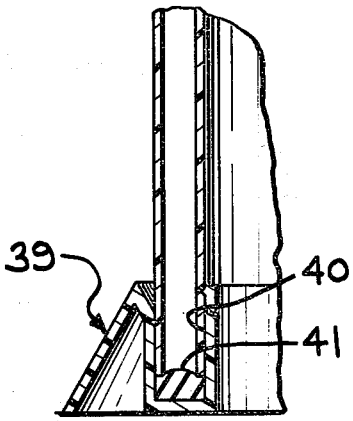
FIG. 14
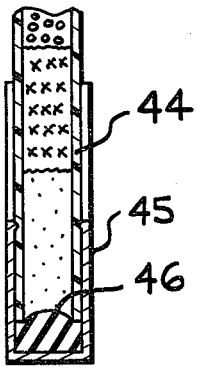
FIG. 16

MEANS FOR PRODUCING MULTI-COLORED HOBBY CRAFT DESIGNS

BACKGROUND OF THE INVENTION

Many different types of hobby craft kits exist which comprise combinations of coloring media (such as paints or crayons of different selected colors), an object providing a surface upon which the colors are to be spread and bearing the outline of a design that defines different areas for different colors, and a color indicia element to instruct the hobbyist with respect to which of the several colors is to be placed in each of the several areas. The color chart simply may be a full color print of the finished design or painting or it may be an outline corresponding to the one on the surface with color indicia such as numbers printed in each of the areas; corresponding numbers being applied to each of the paints or crayons.

Flowable color bearing material such as colored sand or colored wax also has been suggested in the past for the creation of patterns of different layers or swirls of colors within an object such as a bowl or lamp base.

However, as yet no combination of means has been suggested by which flowable color bearing media may be utilized for the production or creation of a picture by the use of such medium. Specifically, while color bearing sand is well known in the hobbycraft art, no means has been provided for the utilization of that material for the creation of a picture or a design comprising areas of color provided by discreet quantities of material of different colors.

It is therefore the principal object of the instant invention to provide a combination for use in making a colored hobbycraft item, the combination comprising a plurality of quantities of flowable color-bearing media and a structure into which media of various colors can be filled in varying quantities and sequence for creating a desired pattern or picture.

Figure 1:
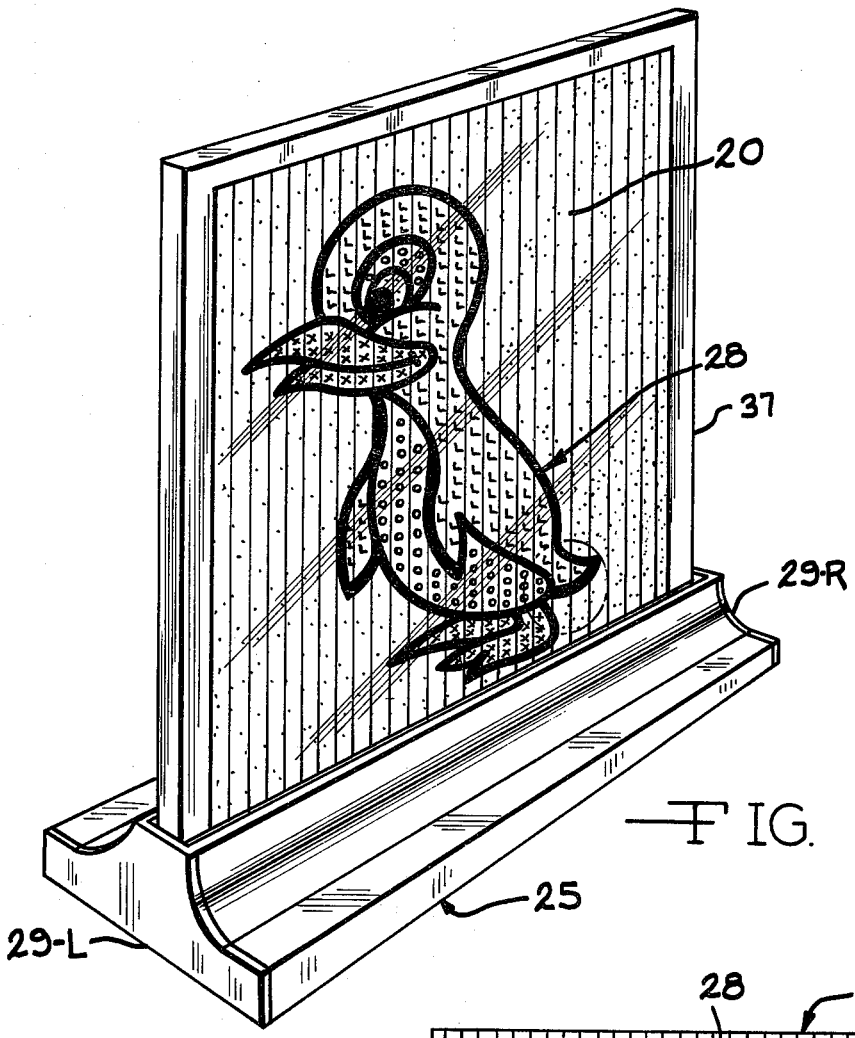
FIG. 1 is a view in perspective of a finished hobby item with the various colors therein indicated by a color code adopted purely for illustrative purposes in this application; the color code corresponding with a "Color Chart" which is the subject matter of FIG. 7.
Figure 3:
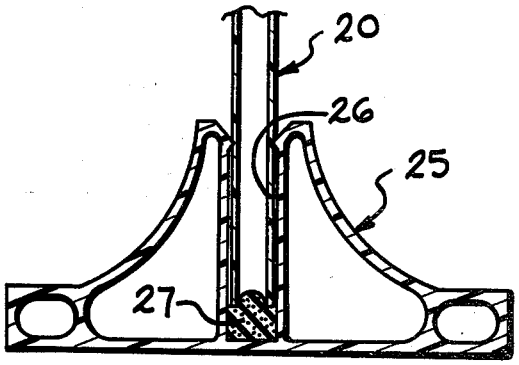
FIG. 3 is a greatly enlarged fragmentary vertical sectional view taken along the line 3—3 of FIG. 2.
Figure 2:
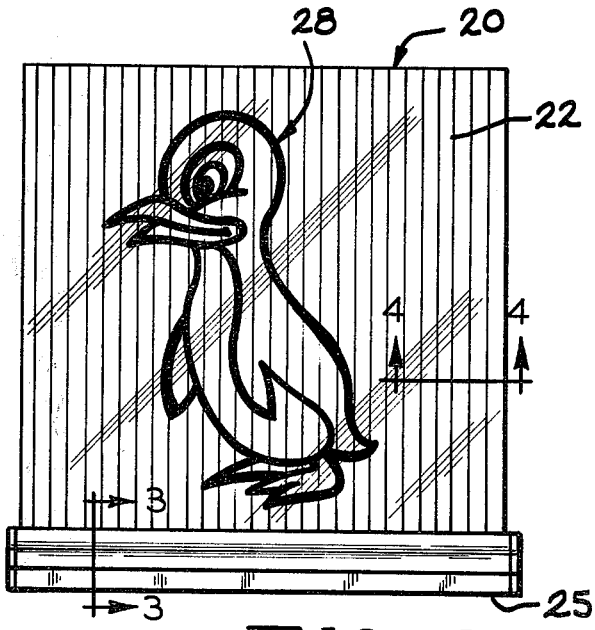
FIG. 2 is a front view in elevation, on a smaller scale, of a structure comprising a plurality of semi-transparent tubes into which the color-bearing media is flowed and illustrating how that structure has imprinted thereon an outline of a design, the outline defining various areas for various colored media.
Figure 4:
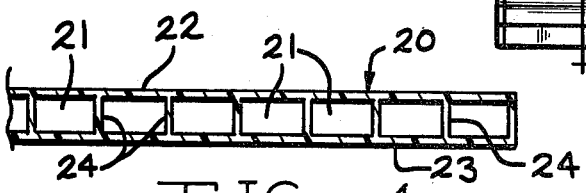
FIG. 4 is a fragmentary horizontal sectional view taken along the line 4—4 of FIG. 2.
Figure 5:
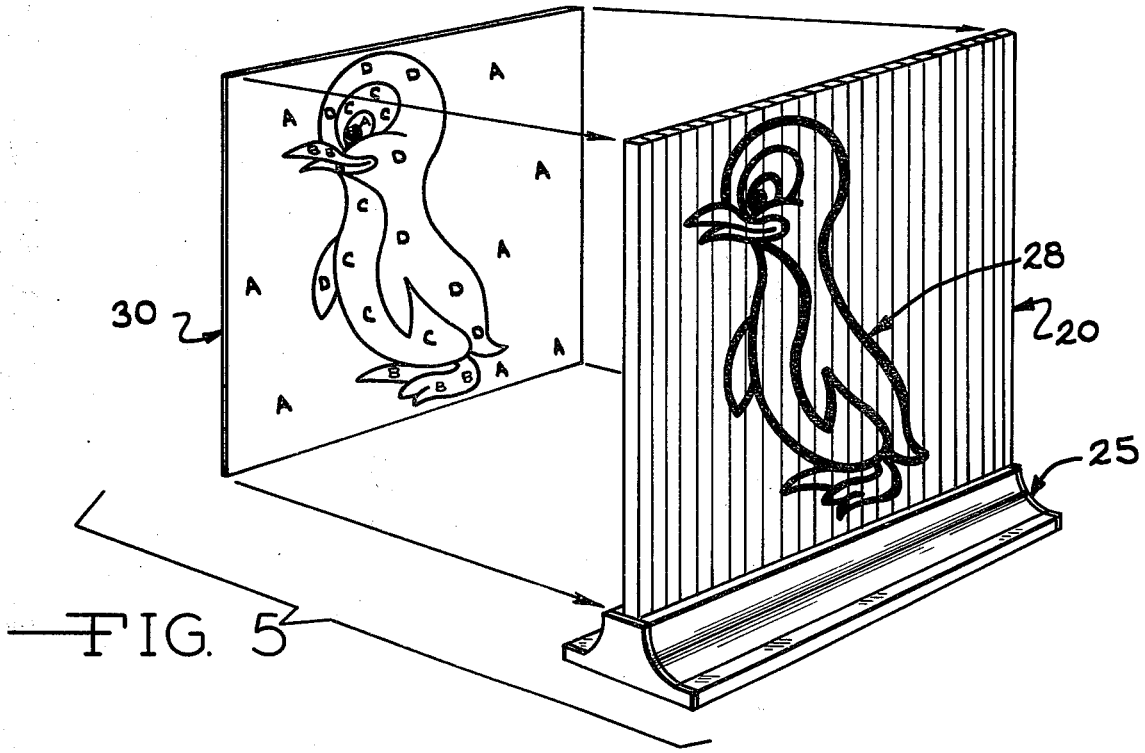
FIG. 5 is a view in perspective of the structure illustrated in FIG. 2 showing how a color indicia chart may be positioned adjacent the back side of the structure for indicating the areas into which the flowable color-bearing media is to be filled to complete the colored picture.
Figure 6:
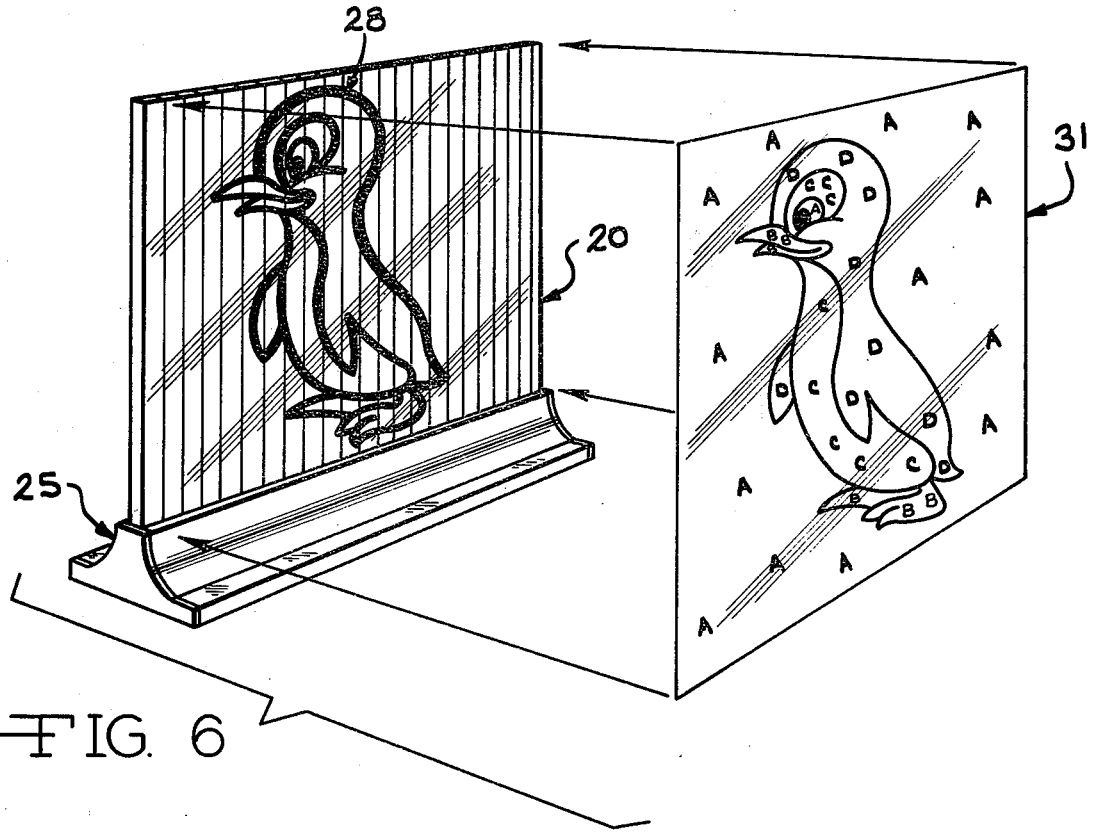
FIG. 6 is a view similar to FIG. 5 but illustrating how a color indicia chart may be superposed over the front of the structure to guide the hobbyist in pouring the media into the various vertical tubes.
Figure 8:
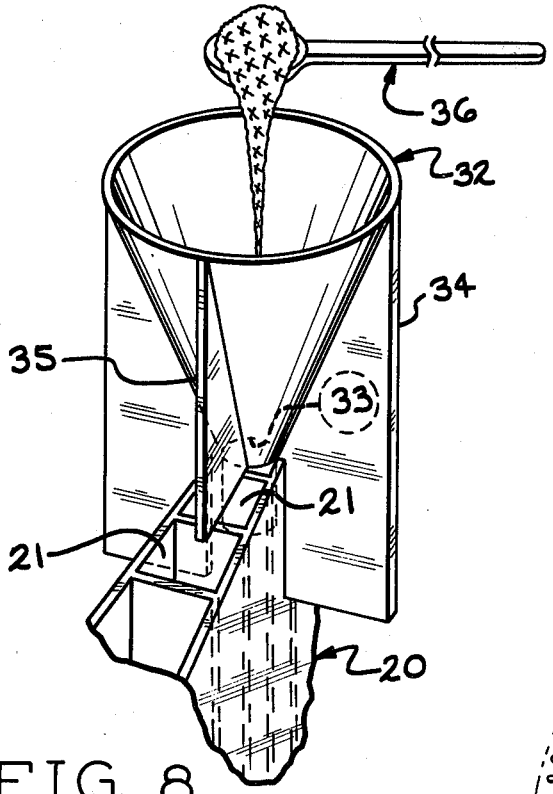
Figure 7:
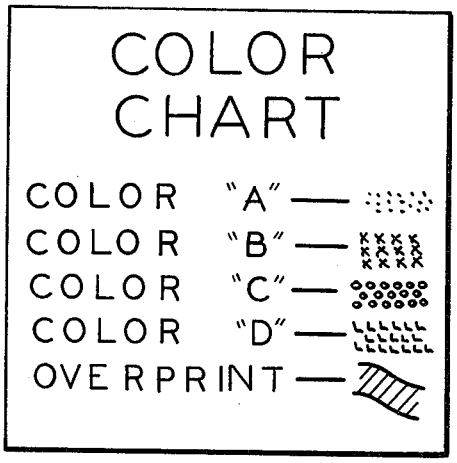
FIG. 7, as mentioned, is a "Color Chart" related only to the indicia utilized in these drawings to illustrate different colors as they might be filled into the structure of FIG. 2 for the creation of a colored picture.
Figure 9:
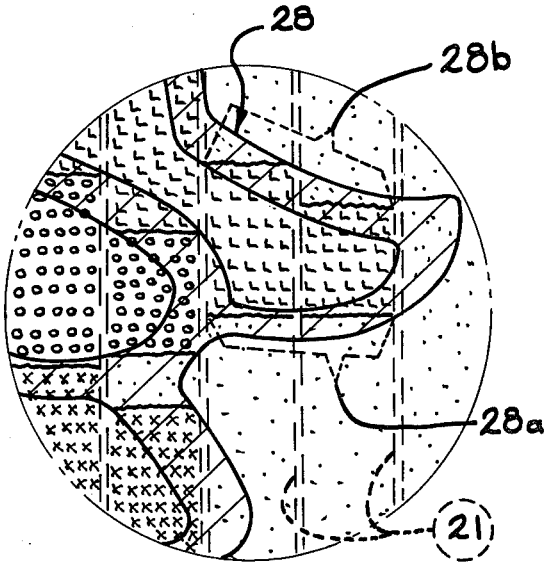
Figure 10:
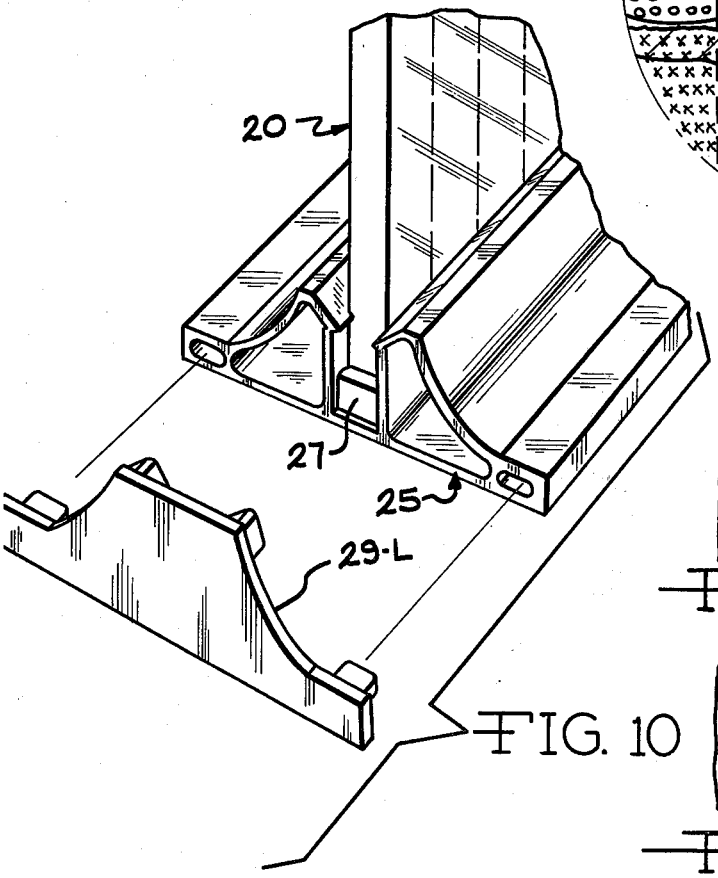
Figure 7A:
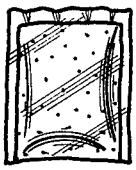
Figure 7B:
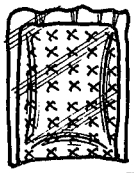
Figure 7C:
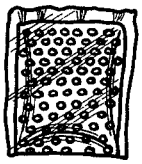
Figure 7D:
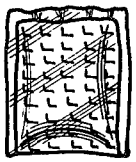

FIGS. *7a*, *7b*, *7c*, and *7d* are small scale illustrations of containers for color-bearing media of different colors with the color code according to the chart of FIG. 7 indicated on the surface of these containers, in this case small bags of color bearing sand;

FIG. 8 is a fragmentary view in perspective showing a small funnel which is utilized for filling the color bearing media into the vertical tubes comprising the structure of FIG. 2;

FIG. 9 is a greatly enlarged portion of the finished hobbycraft item illustrated in FIG. 1 consisting of that area indicated in FIG. 1 by the broken circle so identified as FIG. 9;

FIG. 10 is a greatly enlarged fragmentary view in perspective showing the base or stand of FIG. 3;

FIG. 11 is a fragmentary view, partly in section taken substantially along a vertical median plane of the finished item shown in FIG. 1 illustrating how colored sand or color-bearing sand is filled into the tubes in discreet layers according to the outlined design on the surface of the structure shown in FIG. 2;

FIG. 12 is a view similar to FIG. 11 illustrating how a liquid medium such as colored wax may be utilized for filling in various areas;

FIG. 13 is a view in perspective with parts broken away on a very small scale illustrating how a structure suitable for use in the combination may be fabricated in a circular shape, a design being printed on the exterior thereof that defines the areas of various colors;

FIG. 14 is a fragmentary vertical sectional view along the line 14—14 of FIG. 13 and shown on an enlarged scale;

FIG. 15 is a simplified view of a modified structure for the reception of the flowable color media; and FIG. 16 is a fragmentary vertical sectional view taken along the line 16—16 of FIG. 15.

DESCRIPTION OF PREFERRED EMBODIMENTS

FIGS. 1–11, inclusive, illustrate a preferred combination of elements and structure for use in making a hobbycraft type of picture, preferably utilizing varying quantities of sand or other flowable media having different selected colors. In this embodiment of the invention, a unitary structure generally indicated by the reference number 20 is fabricated from a substantially transparent, plastic material by extrusion and comprises a plurality of parallel tubes 21 having a common front wall 22 and a common back wall 23. Each of the tubes is also bounded by intervening ones of cross walls 24. Thus, the structure 20 comprises a plurality of substantially transparent tubes 21 having identical dimensions.

The combination also includes means for supporting the tubes in vertical position. In this embodiment this means consists of a base generally indicated by the reference number 25 which also may be extruded from a plastic material and which has a vertical slot 26 of such width as to receive the structure 20 in tight embracing relationship when the structure 20 is inserted downwardly into the slot 26. A soft cushion 27 (see also FIG. 11) is positioned in the bottom of the slot 26 so that when the structure 20 is pushed downwardly into the slot 26 the material of the cushion 27 bulges upwardly into the open bottom ends of the tubes 21 thus closing their lower ends.

An outline 28 of a design or a picture which is to be produced by the utilization of the combination embodying the invention, is imprinted or otherwise placed upon the front face 22 of the structure 20. The outline 28 defines various areas each of which is to have a different color when the elements of the combination have been utilized for the production of the hobbycraft picture. In the figures illustrating this embodiment of the invention, particularly FIGS. 1, 2, 5, 6 and 9, the figure shown is that of a stylized penguin and, for illustrative purposes, it is assumed that the picture will be created using only four different colors of flowable medium, in the preferred embodiment, colored sand.

In addition to the structure 20 forming the tubes 21 in this embodiment, the base 25 and the cushion 27, the combination also includes a plurality of supplies of differently colored flowable media, in this case sand. The four colors indicated in the various figures of the drawings, which are merely illustrative of the manner in which various colors can be utilized according to the invention, are indicated by dots, crosses, circles and "L's". While only four colors are so indicated, it will be appreciated, of course, that in a more complicated, detailed design or picture, a greater number of different colored media would be employed with a correspondingly more complicated outline that would define a greater number of discreet areas.

The combination embodying the invention not only includes the items listed just above but also, as mentioned, includes a corresponding number of supplies of differently colored sand illustrated in FIGS. *7a*, *7b*, *7c*, and *7d*. Each of these figures depicts a small sack of a colored sand and the drawings are similarly coded according to the color chart of FIG. 7 to correspond to the color coding which appears on the finished product shown in FIG. 1 and a fragment thereof shown in each of FIGS. 9 and 11.

As shown in FIG. 10, the base 25 has a pair of end plates 29L and 29R for the left and right ends, respectively, of the base 25. While the base 25 is shown as an extrusion and the end plates 29L and 29R are illustrated as finishing off the ends of the base 25, it will be appreciated that the particular configuration of the base 25 is not critical to the invention and any means which will hold the structure 20 in an upright position with the upper ends of the tubes 21 open and the lower ends of the tubes 21 closed, will suffice to carry out the invention.

It also should be noted, particularly with reference to FIG. 9, that the outline 28 is made with relatively heavy lines which vary in their thickness depending upon whether they extend across adjacent tubes 21 horizontally or at an angle to the horizontal. Where the lines extend across the adjacent tubes horizontally they can be relatively thin because the interface between superposed quantities of colored material is horizontal and readily can be hidden behind that portion of the outline 28. However, where the outline 28 is inclined to the vertical, the lines must be proportionately thicker as the angle increases so that where such a line, say at an angle of 45° or more crosses adjacent ones of the tubes 21, that portion of the line comprising a part of the outline 28 must be sufficiently thick as to completely cover the demarcation interface between the vertically superposed quantities of color bearing materials such as sand.

Situations according to the foregoing discussion are illustrated in FIG. 9 where a part of the outline extending substantially horizontally across two adjacent ones of the tubes 21 is bracketed by a bracket indicated by the reference number **28*a* and a portion of the outline 28 extending at an angle of about 45° from the horizontal is bracketed by a second bracket indicated by the reference number 28*b*. As can be seen in FIG. 9, the interface between lower colored medium (dots) and a superposed portion of medium (L's) of a different color readily is hidden behind a thinner portion of the outline 28*a* while the line of demarcation of interface between the color (L's) and a superposed quantity of the earlier color (dots) thereabove would not be hidden unless the section of the outline indicated by the bracket 28*b* were thicker. The same situation prevails relative to other sections of the outline 28 shown in enlarged detail in FIG. 9** at the left part of that figure hiding the lines of demarcation between the colors indicated by the small crosses and those indicated by the small circles, or the like.

In order for the hobbyist to complete the picture utilizing the elements of the instant invention, the combination also includes one form or another of what might be called a "color indicia chart". This color indicia chart simply may be a full color photograph or drawing of the design (in this case the little penguin) in its finished color which may be printed on the box containing the elements of the combination or, if desired, the color chart may be printed in black and white, for example, upon a card such as the card 30 (FIG. 5) which is intended to be held behind the structure 20 thus to indicate through the substantially transparent structure 20 where the media of different colors are to be poured. Alternatively, the color indicia chart may be a transparency such as the transparency 31 illustrated in FIG. 6 which is intended to be placed in front of the structure 20 during the process of filling in the tubes 21 with the colored sand.

In any case, regardless of the particular color indicia chart which is supplied with the particular combination embodying the invention, that combination preferable also includes a funnel (FIG. 8) generally indicated by the reference number 32 which has a nozzle 33 of such size as to fit into the open upper end of each of the tubes 21 and which has vanes 34 and 35. The vanes 34 are long enough to extend down on opposite sides of the structure 20 and the vanes 35 are shorter so that they rest upon the tops of the cross walls 24.

Thus, a hobbyist, utilizing a small tool such as a spoon 36, pours a quantity of that one of the colored sands sufficient to fill a space in the particular tube in question extending upwardly, for example, from the base to the level in the tubes indicated by the bracket **28*a* in FIG. 9. He then selects a quantity of the second color indicated on the color indicia chart as extending upwardly therefrom and pours that quantity into the same tubes to fill in the area just above the portion of the outline indicated by the bracket 28*a* until he reaches the levels in the two adjacent tubes 21 covered by that portion of the outline indicated by the bracket 28*b* in FIG. 9. A similar procedure is carried out relative to each of the tubes 21 progressively across the structure 20 until the proper quantities of the right colors are superposed one upon the other with the interfaces or demarcation lines between the colors hidden by the outline 28** as described.

It will be appreciated that the color values which are apparent in the finished product as illustrated in FIG. 1 depend upon the color tones of the color bearing media provided and also upon the degree of transparency of the material from which the structure 20 is fabricated. It will also be appreciated that while the pattern used in the drawings and described herein to illustrate the invention is very simple, by the suitable selection of colors and comparative areas much more complex pictures may be produced by the utilization of a number of colored media greater than four.

Although the preferred embodiment of the combination utilizes colored sand for the purpose of producing the colored areas in each of the tubes 21 and in areas comprising adjacent ones of the tubes 21, other color bearing media also may be employed according to the invention. For example, the combination may include a number of pieces of low melting point wax of different colors which are poured into the respective tubes. Again, the interfaces between vertically superposed quantities of waxes of different colors would be horizontal and the thicknesses of the lines constituting the outline 28 would vary depending upon the angle relative to the horizontal of the portions of the lines which cross adjacent ones of the tubes 21.

After all of the various colored or color bearing media have been flowed into the respective ones of the tubes 21 so that the entire structure 20 is filled from bottom to top, the structure 20 is enclosed by a suitable border 37, for example, a strip of black plastic, pressure sensitive tape, pieces of U-shaped extruded plastic, or the like.

While the structure 20 illustrated in FIGS. 1–11, inclusive, is generally planar, structure according to the invention also may be provided in shapes other than planar. For example, a tubular structure 38, illustrated in FIG. 13, may be extruded as a single unit or it may be assembled from four quarter circle units all of them being erected in an annular base 39 having a slot 40 into which the structure 38 is inserted and also having a cushion 41 for closing the open bottom ends of tubes in the structure 38. As in the earlier described embodiment, the structure 38 may have imprinted upon it a design generally indicated by the reference number 42 which defines the areas to be filled in with colored media of colors according to a color indicia chart. After filling all of the tubes in the structure 38, their tops may be capped by a ring 43 of U-shaped cross section.

Although the preferred embodiment of the invention as discussed utilizes a unitary structure which comprises the various tubes into which the colored media are to be poured, the basic concept of the invention also can be realized through the utilization of a plurality of individual, substantially transparent tubes 44 erected vertically in a unitary array through the use of a base 45 and, as in the earlier embodiment, a soft cushion 46 to close the bottom ends of the tubes 44. The base 45 illustrated in FIG. 15 also can function as a clip **45*a* to hold the upper ends of the tubes 44 in close adjacency as is illustrated in FIG. 15**.

After filling the various tubes 44 in accordance with the procedure outlined above, the clip **45*a* may then be removed from its position illustrated in FIG. 15 and inserted over the tops of the tubes 44, its arms being directly downwardly in opposition to the base 45 for retaining the filled tubes 44** in their upright position.

While the foregoing description has spoken of a predetermined design, such as the little penguin, being imprinted or otherwise indicated on the surface of the tubes, it is also intended that a combination according to the invention may be utilized by an individual hobbyist for the creation of a new original design where the color bearing media would be poured in superposed quantities in the tubes of any type or style to create a pattern pleasing to the eye of the individual.

Having described my invention, I claim:

1. For use in making a multi-colored sand art hobby craft item, the combination comprising (a) a unitary array consisting of a plurality of substantially transparent tubes having substantially identical dimensions and having open upper ends, (b) means for supporting said array of tubes extending vertically with their lower ends closed, (c) one vertical face of said array of tubes having imprinted thereon an outline design defining individual specific areas to be colored differently, including areas for one color located below areas for other colors and areas for one color surrounded by areas for other colors, the outline of the design being opaque and the lines thereof being of different thicknesses as necessary to mask the interfaces of vertically superposed quantities of sand having different colors for the areas above and below such lines, and (d) a plurality of supplies of sand of various colors selected to conform to the colors of the various areas of the design to be poured into the open upper ends of said tubes in varying quantities and sequence for filling in each of the individual portions of the design.

2. A combination according to claim 1 and a color indicia chart corresponding to the design on the unitary structure.

3. A combination according to claim 1 in which the unitary structure is substantially planar.

4. A combination according to claim 1 in which the outline on the structure is defined by lines of increasing thickness as such lines extend at greater angles to the horizontal.

5. A combination according to claim 1 in which the means for supporting the structure has a slot into which the structure is inserted and the means for closing the lower ends of the tubes is a deformable material located in the bottom of the slot.

* * * * *